US008688437B2

(12) United States Patent
Gao

(10) Patent No.: US 8,688,437 B2
(45) Date of Patent: Apr. 1, 2014

(54) PACKET LOSS CONCEALMENT FOR SPEECH CODING

(75) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 152 days.

(21) Appl. No.: 13/194,982

(22) Filed: Jul. 31, 2011

(65) Prior Publication Data

US 2012/0323567 A1 Dec. 20, 2012

Related U.S. Application Data

(63) Continuation-in-part of application No. 11/942,118, filed on Nov. 19, 2007, now Pat. No. 8,010,351.

(60) Provisional application No. 60/877,171, filed on Dec. 26, 2006.

(51) Int. Cl.
*G10L 19/09* (2013.01)

(52) U.S. Cl.
USPC ..... 704/201

(58) Field of Classification Search
USPC ..... 704/201
See application file for complete search history.

(56) References Cited

U.S. PATENT DOCUMENTS 8,010,351 B2 * 8/2011 Gao ..... 704/207
8,433,563 B2 * 4/2013 Vos et al. ..... 704/219

* cited by examiner

*Primary Examiner* — Susan McFadden
(74) *Attorney, Agent, or Firm* — Conley Rose, P.C.; Grant Rodolph; Nicholas K. Beaulieu

(57) ABSTRACT

A speech coding method of significantly reducing error propagation due to voice packet loss, while still greatly profiting from a pitch prediction or Long-Term Prediction (LTP), is achieved by limiting or reducing a pitch gain only for the first subframe or the first two subframes within a speech frame. The method is used for a voiced speech class; a pitch cycle length is compared to a subframe size to decide to reduce the pitch gain for the first subframe or the first two subframes within the frame. Speech coding quality loss due to the pitch gain reduction is compensated by increasing a bit rate of a second excitation component or adding one more stage of excitation component only for the first subframe or the first two subframes within the speech frame.

20 Claims, 9 Drawing Sheets

Basic Speech Encoder Based on Analysis-by-Synthesis

FIG. 1 Initial CELP Speech Encoder

FIG. 2 Initial CELP Speech Decoder

FIG.3 Basic CELP Speech Encoder

FIG.4 Basic CELP Speech Decoder

FIG. 5 Example for (Pitch<=Subframe Size)

FIG. 6 Example for (Pitch>Subframe Size) & (Pitch<=Half Frame Size)

FIG.7 Basic Speech Encoder Based on Analysis-by-Synthesis

FIG.8 Basic Speech Decoder Based on Analysis-by-Synthesis

PACKET LOSS CONCEALMENT FOR SPEECH CODING

CROSS REFERENCE TO RELATED APPLICATION

This application is a continuation-in-part of application Ser. No. 11/942,118, filed Nov. 19, 2007, entitled "Speech Coding System to Improve Packet Loss Concealment", which claims priority to U.S. Provisional Application No. 60/877,171, filed on Dec. 26, 2006, entitled "A Speech Coding System to Improve Packet Loss Concealment". The following applications are incorporated by reference in their entirety and made part of this application:

U.S. patent application Ser. No. 11/942,102, entitled "Gain Quantization System for Speech Coding to Improve Packet Loss Concealment," filed Nov. 19, 2007, which claims priority to U.S. Provisional Application No. 60/877,173, filed on Dec. 26, 2006, entitled "A Gain Quantization System for Speech Coding to Improve Packet Loss Concealment";

U.S. patent application Ser. No. 12/177,370, entitled "Apparatus for Improving Packet Loss, Frame Erasure, or Jitter Concealment," filed on Jul. 22, 2008, which claims priority to U.S. Provisional Application No. 60/962,471, filed on Jul. 30, 2007, entitled "Apparatus for Improving Packet Loss, Frame Erasure, or Jitter Concealment";

U.S. patent application Ser. No. 11/942,066, entitled "Dual-Pulse Excited Linear Prediction For Speech Coding," filed Nov. 19, 2007, which claims priority to U.S. Provisional Application No. 60/877,172, filed on Dec. 26, 2006, entitled "Dual-Pulse Excited Linear Prediction For Speech Coding";

U.S. patent application Ser. No. 12/203,052, entitled "Adaptive Approach to Improve G.711 Perceptual Quality," filed on Sep. 2, 2008, which claims priority to U.S. Provisional Application No. 60/997,663, filed on Sep. 2, 2007, entitled "Adaptive Approach to Improve G.711 Perceptual Quality".

TECHNICAL FIELD

The present invention is generally in the field of digital signal coding/compression. In particular, the present invention is in the field of speech coding or specifically in application where packet loss is an important issue during voice packet transmission.

BACKGROUND OF THE INVENTION

Traditionally, all parametric speech coding methods make use of the redundancy inherent in the speech signal to reduce the amount of information that must be sent and to estimate the parameters of speech samples of a signal at short intervals. This redundancy primarily arises from the repetition of speech wave shapes at a quasi-periodic rate, and the slow changing spectral envelop of speech signal.

The redundancy of speech wave forms may be considered with respect to several different types of speech signal, such as voiced and unvoiced. For voiced speech, the speech signal is essentially periodic; however, this periodicity may be variable over the duration of a speech segment and the shape of the periodic wave usually changes gradually from segment to segment. A low bit rate speech coding could greatly benefit from exploring such periodicity. The voiced speech period is also called pitch and pitch prediction is often named Long-Term Prediction. As for the unvoiced speech, the signal is more like a random noise and has a smaller amount of predictability.

In either case, parametric coding may be used to reduce the redundancy of the speech segments by separating the excitation component of the speech from the spectral envelop component. The slowly changing spectral envelope can be represented by Linear Prediction (also called Short-Term Prediction). A low bit rate speech coding could also benefit a lot from exploring such a Short-Term Prediction. The coding advantage arises from the slow rate at which the parameters change. Yet, it is rare for the parameters to be significantly different from the values held within a few milliseconds. Accordingly, at the sampling rate of 8 kHz or 16 kHz, the speech coding algorithm is such that the nominal frame duration is in the range of ten to thirty milliseconds. A frame duration of twenty milliseconds seems to be the most common choice. In more recent well-known standards such as G.723.1, G.729, EFR or AMR, the Code Excited Linear Prediction Technique ("CELP") has been adopted; CELP is commonly understood as a technical combination of Code-Excitation, Long-Term Prediction and Short-Term Prediction. Code-Excited Linear Prediction (CELP) Speech Coding is a very popular algorithm principle in speech compression area.

CELP algorithm is often based on an analysis-by-synthesis approach which is also called a closed-loop approach. In an initial CELP encoder, a weighted coding error between a synthesized speech and an original speech is minimized by using the analysis-by-synthesis approach. The weighted coding error is generated by filtering a coding error with a weighting filter W(z). The synthesized speech is produced by passing an excitation through a Short-Term Prediction (STP) filter which is often noted as 1/A(z); the STP filter is also called Linear Prediction Coding (LPC) filter or synthesis filter. One component of the excitation is called Long-Term Prediction (LTP) component; the Long-Term Prediction can be realized by using an adaptive codebook (AC) containing a past synthesized excitation; pitch periodic information is employed to generate the adaptive codebook component of the excitation; the LTP filter can be marked as 1/B(z); the LTP excitation component is scaled at least by one gain $G_p$. There is at least a second excitation component. In CELP, the second excitation component is called code-excitation, also called fixed codebook excitation, which is scaled by a gain $G_c$. The name of fixed codebook comes from the fact that the second excitation is produced from a fixed codebook in the initial CELP codec. In general, it is not always necessary to generate the second excitation from a fixed codebook. In many recent CELP coder, actually, there is no real fixed codebook. In a decoder, a post-processing block is often applied after the synthesized speech, which could include long-term post-processing and/or short-term post-processing.

Long-Term Prediction plays an important role for voiced speech coding because voiced speech has strong periodicity. The adjacent pitch cycles of voiced speech are similar each other, which means mathematically the pitch gain $G_p$ in the excitation express, $e(n)=G_p \cdot e_p(n)+G_c \cdot e_c(n)$, is very high; $e_p(n)$ is one subframe of sample series indexed by n, coming from the adaptive codebook which consists of the past excitation; $e_c(n)$ is generated from the code-excitation codebook (fixed codebook) or produced without using any fixed codebook; this second excitation component is the current excitation contribution. For voiced speech, the contribution of $e_p(n)$ could be dominant and the pitch gain $G_p$ is around a value of 1. The excitation is usually updated for each subframe. Typical frame size is 20 milliseconds and typical subframe size is 5 milliseconds. If a previous bit-stream packet is lost and the pitch gain $G_p$ is high, the incorrect estimate of the previous synthesized excitation could cause error propagation for quite long time after the decoder has already received a correct bit-stream packet. The partial reason of this error propagation is that the phase relationship between $e_p(n)$ and $e_c(n)$ has been changed due to the previous bit-stream packet loss. One simple solution to solve this issue is just to completely cut (remove) the pitch contribution between frames; this means the pitch gain $G_p$ is set to zero in the encoder. Although this kind of solution solved the error propagation problem, it sacrifices too much the quality when there is no bit-stream packet loss or it requires much higher bit rate to achieve the same quality. The invention explained in the following will provide a compromised solution.

A common problem of parametric speech coding is that some parameters may be very sensitive to packet loss or bit error happening during transmission from an encoder to a decoder. If a transmission channel may have a very bad condition, it is really worth to design a speech coder with a good compromising between speech coding quality at a good channel condition and speech coding quality at a bad channel condition.

SUMMARY OF THE INVENTION

In accordance with the purpose of the present invention as broadly described herein, there is provided method and system for speech coding.

For most voiced speech, one frame contains several pitch cycles. If the speech is voiced, a compromised solution to avoid the error propagation while still profiting from the significant long-term prediction is to limit the pitch gain maximum value for the first pitch cycle of each frame or reduce the pitch gain (equivalent to reducing the LTP component energy) for the first subframe. A speech signal can be classified into different cases and treated differently. For example, Class 1 is defined as (strong voiced) and (pitch<=subframe size); Class 2 is defined as (strong voiced) and (pitch>subframe & pitch<=half frame); Class 3 is defined as (strong voiced) and (pitch>half frame); Class 4 represents all other cases. In case of Class 1, Class 2, or Class 3, for the subframes which cover the first pitch cycle within the frame, the pitch gain is limited or reduced to a maximum value (depending on Class) smaller than 1, and the code-excitation codebook size could be larger than the other subframes within the same frame, or one more stage of excitation component is added to compensate for the lower pitch gain, which means that the bit rate of the second excitation is higher than the bit rate of the second excitation in the other subframes within the same frame. For the other subframes rather than the first pitch cycle subframes, or for Class 4, a regular CELP algorithm or an analysis-by-synthesis approach is used, which minimizes a coding error or a weighted coding error in a closed loop. In summary, at least one Class is defined as having high pitch gain, strong voicing, and stable pitch lags; the pitch lags or the pitch gains for the strongly voiced frame can be encoded more efficiently than the other classes. The Class index (class number) assigned above to each defined class can be changed without changing the result.

In some embodiments, a method of improving packet loss concealment for speech coding while still profiting from a pitch prediction or Long-Term Prediction (LTP), the method comprising: having an LTP excitation component; having a second excitation component; determining an initial energy of the LTP excitation component for every subframe within a frame of speech signal by using a regular method of minimizing a coding error or a weighted coding error at an encoder; reducing or limiting the energy of the LTP excitation component to be smaller than the initial energy of the LTP excitation component for the first subframe within the frame; keeping the energy of the LTP excitation component to be equal to the initial energy of the LTP excitation component for any other subframe rather than the first subframe within the frame; encoding the energy of the LTP excitation component for every subframe of the frame at the encoder; and forming an excitation by including the LTP excitation component and the second excitation component.

Encoding the energy of the LTP excitation component comprises encoding a gain factor which is limited or reduced to the value for the first subframe to be smaller than 1. Coding quality loss due to the gain factor reduction is compensated by increasing coding bit rate of the second excitation component of the first subframe to be larger than coding bit rate of the second excitation component of any other subframe within the frame. Coding quality loss due to the gain factor reduction can also be compensated by adding one more stage of excitation component to the second excitation component for the first subframe rather than the other subframes within the frame. The energy limitation or reduction of the LTP excitation component for the first subframe within the frame is employed for voiced speech and not for unvoiced speech.

The initial energy of the LTP excitation component and the second excitation component are determined by using an analysis-by-synthesis approach. An example of the analysis-by-synthesis approach is Code-Excited Linear Prediction (CELP) methodology.

In other embodiments, a method of improving packet loss concealment for speech coding while still profiting from a pitch prediction or Long-Term Prediction (LTP), the method comprising: classifying a plurality of speech frames into a plurality of classes; and at least for one of the classes, the following steps are included: having an LTP excitation component; having a second excitation component; determining an initial energy of the LTP excitation component for every subframe within a frame of speech signal by using a regular method of minimizing a coding error or a weighted coding error at an encoder; comparing a pitch cycle length with a subframe size within a speech frame; reducing or limiting the energy of the LTP excitation component to be smaller than the initial energy of the LTP excitation component for the first subframe or the first two subframes within the frame, depending on the pitch cycle length compared to the subframe size; keeping the energy of the LTP excitation component to be equal to the initial energy of the LTP excitation component for any other subframe rather than the first subframe or the first two subframes within the frame; encoding the energy of the LTP excitation component for every subframe of the frame at the encoder; and forming an excitation by including the LTP excitation component and the second excitation component.

Encoding the energy of the LTP excitation component comprises encoding a gain factor which is limited or reduced to the value for the first subframe to be smaller than 1. Coding quality loss due to the gain factor reduction is compensated by increasing coding bit rate of the second excitation component of the first subframe or the first two subframes to be larger than coding bit rate of the second excitation component of any other subframe within the frame. Coding quality loss due to the gain factor reduction can also be compensated by adding one more stage of excitation component to the second excitation component for the first subframe or the first two subframes rather than the other subframes within the frame. The energy limitation or reduction of the LTP excitation component for the first subframe or the first two subframes within the frame is employed for voiced speech and not for unvoiced speech.

In other embodiments, a method of improving packet loss concealment for speech coding while still profiting from a pitch prediction or Long-Term Prediction (LTP), the method comprising: classifying a plurality of speech frames into a plurality of classes; and at least for one of the classes, the following steps are included: having an LTP excitation component; having a second excitation component; deciding a first subframe size based on a pitch cycle length within a speech frame; determining an initial energy of the LTP excitation component for every subframe within a frame of speech signal by using a regular method of minimizing a coding error or a weighted coding error at an encoder; reducing or limiting the energy of the LTP excitation component to be smaller than the initial energy of the LTP excitation component for the first subframe within the frame; keeping the energy of the LTP excitation component to be equal to the initial energy of the LTP excitation component for any other subframe rather than the first subframe within the frame; encoding the energy of the LTP excitation component for every subframe of the frame at the encoder; and forming an excitation by including the LTP excitation component and the second excitation component. Encoding the energy of the LTP excitation component comprising encoding a gain factor.

In other embodiments, a method of efficiently encoding a voiced frame, the method comprising: classifying a plurality of speech frames into a plurality of classes; and at least for one of the classes, the following steps are included: having an LTP excitation component; having a second excitation component; encoding an energy of the LTP excitation component by encoding a pitch gain; checking if a pitch track or pitch lags within the voiced frame are stable from one subframe to a next subframe; checking if the voiced frame is strongly voiced by checking if pitch gains within the voiced frame are high; encoding the pitch lags or the pitch gains efficiently by a differential coding from one subframe to a next subframe if the voiced frame is strongly voiced and the pitch lags are stable; and forming an excitation by including the LTP excitation component and the second excitation component. The energy of the LTP excitation component and the second excitation component can be determined by using an analysis-by-synthesis approach, which can be a Code-Excited Linear Prediction (CELP) methodology.

In accordance with a further embodiment, a non-transitory computer readable medium has an executable program stored thereon, where the program instructs a microprocessor to decode an encoded audio signal to produce a decoded audio signal, where the encoded audio signal includes a coded representation of an input audio signal. The program also instructs the microprocessor to do a high band coding of audio signal with a bandwidth extension approach.

The foregoing has outlined rather broadly the features of an embodiment of the present invention in order that the detailed description of the invention that follows may be better understood. Additional features and advantages of embodiments of the invention will be described hereinafter, which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

The making and using of the embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to various embodiments in a specific context, a system and method for speech/audio coding and decoding. Embodiments of the invention may also be applied to other types of signal processing. The present invention discloses a switched long-term pitch prediction approach which improves packet loss concealment. The following description contains specific information pertaining to the Code Excited Linear Prediction (CELP) Technique. However, one skilled in the art will recognize that the present invention may be practiced in conjunction with various speech coding algorithms different from those specifically discussed in the present application. Moreover, some of the specific details, which are within the knowledge of a person of ordinary skill in the art, are not discussed to avoid obscuring the present invention.

The drawings in the present application and their accompanying detailed description are directed to merely example embodiments of the invention. To maintain brevity, other embodiments of the invention which use the principles of the present invention are not specifically described in the present application and are not specifically illustrated by the present drawings.

Figure 1:
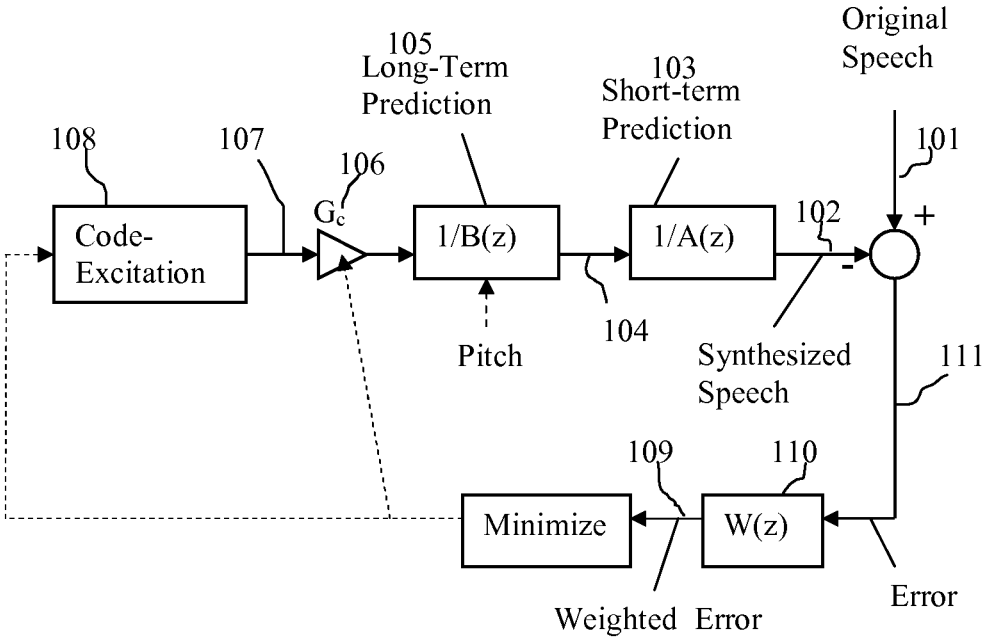
FIG. 1 shows an initial CELP encoder.

FIG. 1 shows an initial CELP encoder where a weighted error 109 between a synthesized speech 102 and an original speech 101 is minimized often by using a so-called analysis-by-synthesis approach. W(z) is an error weighting filter 110. 1/B(z) is a long-term linear prediction filter 105; 1/A(z) is a short-term linear prediction filter 103. The code-excitation 108, which is also called fixed codebook excitation, is scaled by a gain $G_c$ 107 before going through the linear filters. The short-term linear filter 103 is obtained by analyzing the original signal 101 and represented by a set of coefficients:

$$A(z) = \sum_{i=1}^{P} 1 + a_i \cdot z^{-i},\ i = 1, 2, \ldots, P \tag{1}$$

The weighting filter 110 is somehow related to the above short-term prediction filter. A typical form of the weighting filter could be $$W(z) = \frac{A(z/\alpha)}{A(z/\beta)}, \tag{2}$$

where $\beta<\alpha$, $0<\beta<1$, $0<\alpha\leq 1$. The long-term prediction 105 depends on pitch and pitch gain; a pitch can be estimated from the original signal, residual signal, or weighted original signal. The long-term prediction function in principal can be expressed as $$B(z)=1-\beta\cdot z^{-Pitch} \tag{3}$$

The code-excitation 108 normally consists of pulse-like signal or noise-like signal, which are mathematically constructed or saved in a codebook. Finally, the code-excitation index, quantized gain index, quantized long-term prediction parameter index, and quantized short-term prediction parameter index are transmitted to the decoder.

Figure 2:
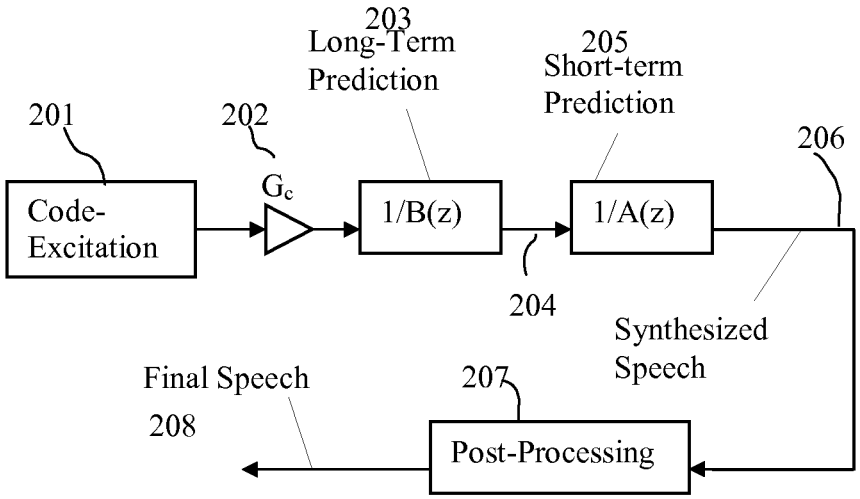
FIG. 2 shows an initial decoder which adds the post-processing block.

FIG. 2 shows an initial decoder which adds a post-processing block 207 after the synthesized speech 206. The decoder is a combination of several blocks which are code-excitation 201, a long-term prediction 203, a short-term prediction 205 and post-processing 207. Every block except the post-processing has the same definition as described in the encoder of FIG. 1. The post-processing could further consist of a short-term post-processing and a long-term post-processing.

Figure 3:
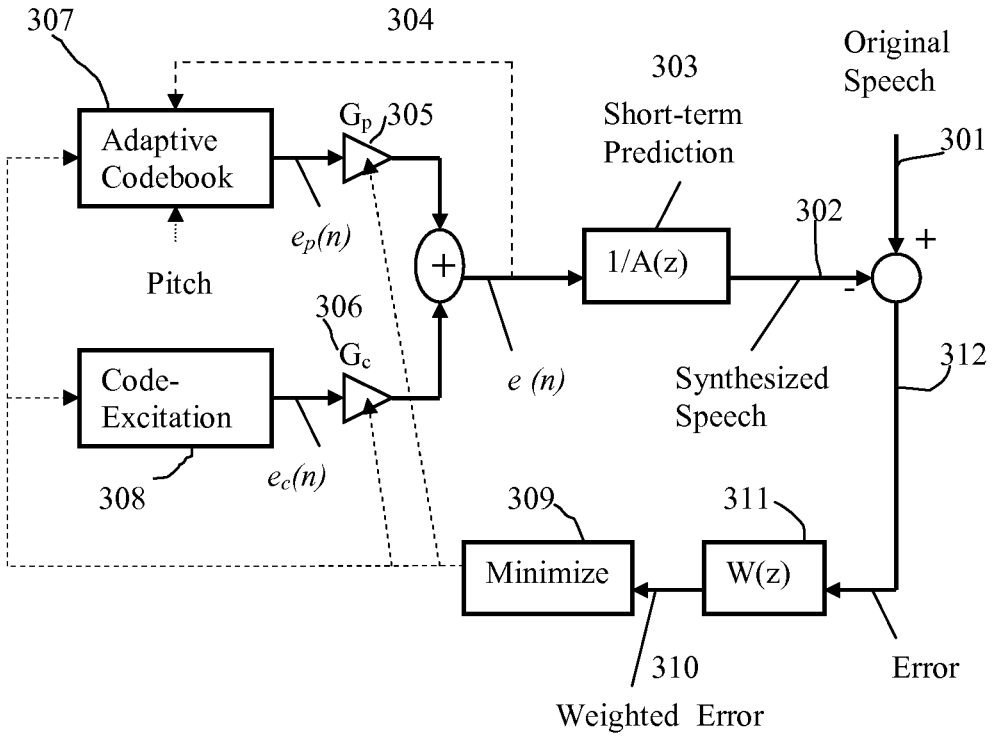
FIG. 3 shows a basic CELP encoder which realized the long-term linear prediction by using an adaptive codebook.

FIG. 3 shows a basic CELP encoder which realizes the Long-Term Prediction by using an adaptive codebook 307, $e_p(n)$, containing a past synthesized excitation 304. A periodic pitch information is employed to generate the adaptive component of the excitation. This excitation component is then scaled by a gain 305 ($G_p$, also called pitch gain). The code-excitation 308, $e_c(n)$, is scaled by a gain $G_c$ 306. The two scaled excitation components are added together before going through the short-term linear prediction filter 303. The two gains ($G_p$ and $G_c$) need to be quantized and then sent to a decoder.

Figure 4:
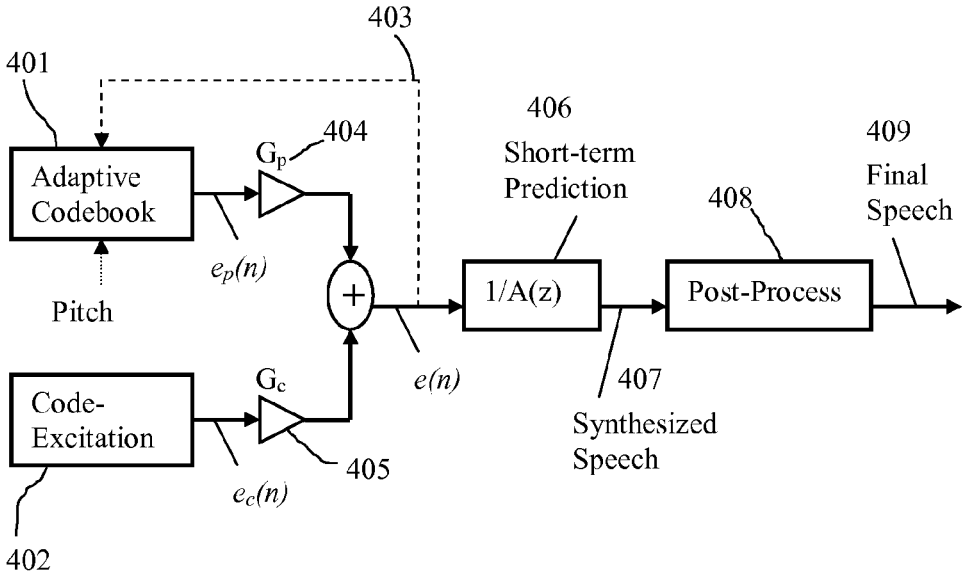
FIG. 4 shows a basic decoder corresponding to the encoder in FIG. 3.

FIG. 4 shows a basic decoder corresponding to the encoder in FIG. 3, which adds a post-processing block 408 after the synthesized speech 407. This decoder is similar to FIG. 2 except the adaptive codebook 307. The decoder is a combination of several blocks which are the code-excitation 402, the adaptive codebook 401, the short-term prediction 406 and the post-processing 408. Every block except the post-processing has the same definition as described in the encoder of FIG. 3. The post-processing could further consist of a short-term post-processing and a long-term post-processing.

Figure 7:
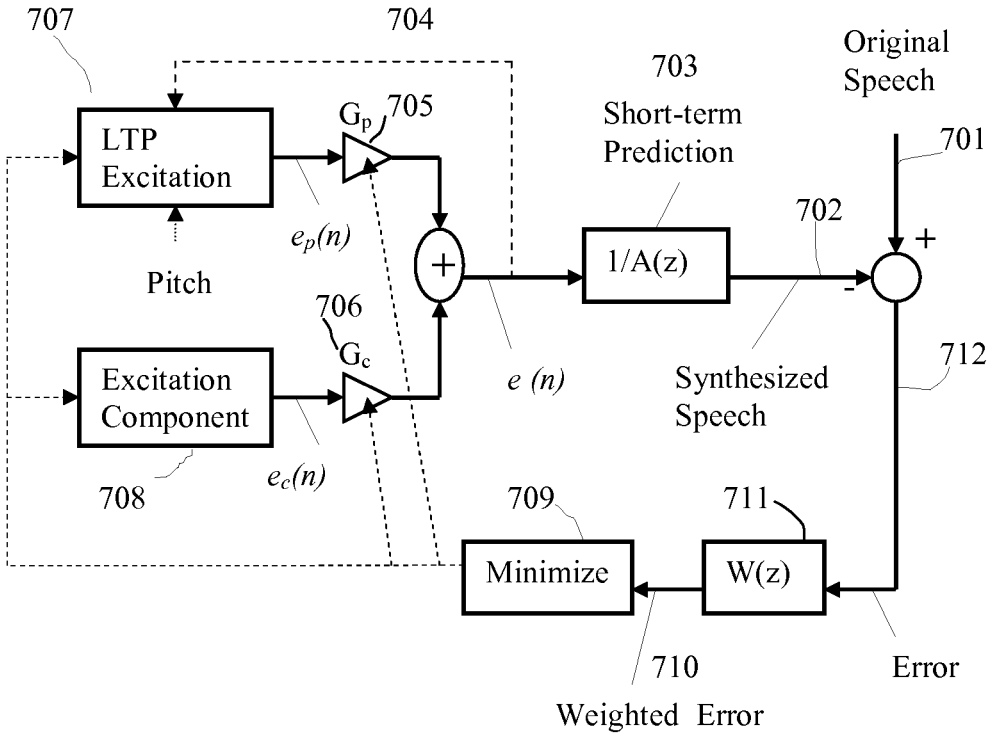
FIG. 7 shows an encoder based on an analysis-by-synthesis approach.

FIG. 7 shows a basic encoder based on an analysis-by-synthesis approach, which generates an Long-Term Prediction excitation component 707, $e_p(n)$, containing a past synthesized excitation 704. A periodic pitch information is employed to generate the LTP excitation component of the excitation. This LTP excitation component is then scaled by a gain 705 ($G_p$, also called pitch gain). The second excitation component 708, $e_c(n)$, is scaled by a gain $G_c$ 706. The two scaled excitation components are added together before going through the short-term linear prediction filter 703. The two gains ($G_p$ and $G_c$) need to be quantized and then sent to a decoder.

Figure 8:
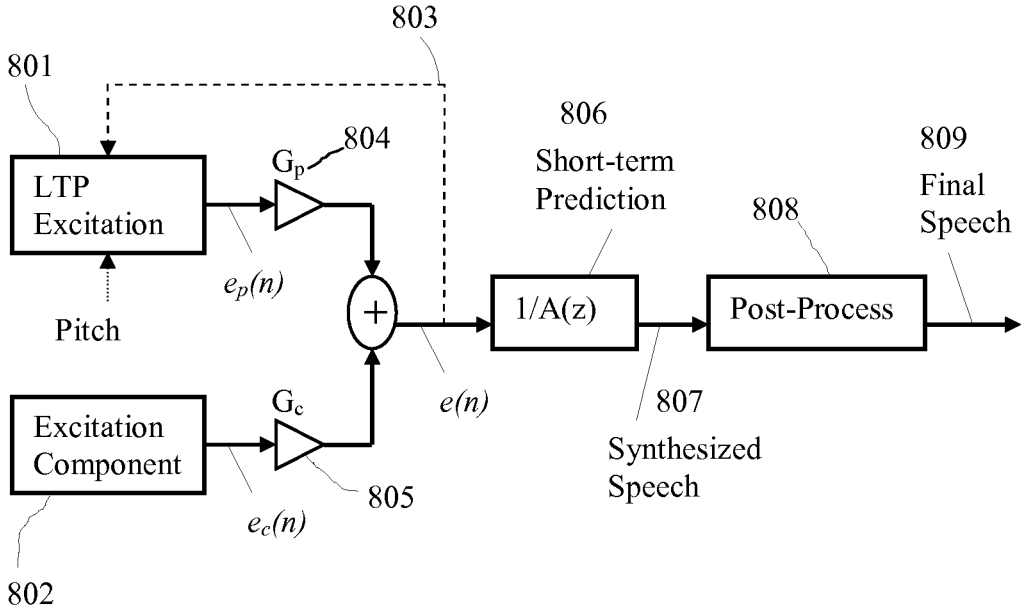
FIG. 8 shows a decoder corresponding to the encoder in FIG. 7.

FIG. 8 shows a basic decoder corresponding to the encoder in FIG. 7, which adds a post-processing block 808 after the synthesized speech 807. This decoder is similar to FIG. 4 except the two excitation components 801 and 802 are expressed in a more general notations. The decoder is a combination of several blocks which are the second excitation component 802, the LTP excitation component 801, the short-term prediction 806 and the post-processing 808. Every block except the post-processing has the same definition as described in the encoder of FIG. 7. The post-processing could further consist of a short-term post-processing and a long-term post-processing.

FIG. 3 and FIG. 7 illustrate examples capable of embodying the present invention. With reference to FIG. 3, FIG. 4, FIG. 7 and FIG. 8, the long-term prediction plays an important role for voiced speech coding because voiced speech has strong periodicity. The adjacent pitch cycles of voiced speech are similar each other, which means mathematically the pitch gain $G_p$ in the following excitation express is very high, $$e(n)=G_p\cdot e_p(n)+G_c\cdot e_c(n) \tag{4}$$

where $e_p(n)$ is one subframe of sample series indexed by n, coming from the adaptive codebook 307 or the LTP excitation component 707 which consists of the past excitation 304 or 704; $e_c(n)$ is from the code-excitation codebook 308 (also called fixed codebook) or the second excitation component 708 which is the current excitation contribution. For voiced speech, the contribution of $e_p(n)$ from the adaptive codebook 307 or the LTP excitation component 707 could be dominant and the pitch gain $G_p$ 305 or 705 is around a value of 1. The excitation is usually updated for each subframe. Typical frame size is 20 milliseconds and typical subframe size is 5 milliseconds. If a previous bit-stream packet is lost and the pitch gain $G_p$ is high, an incorrect estimate of the previous synthesized excitation can cause error propagation for quite long time after the decoder has already received a correct bit-stream packet. The partial reason of this error propagation is that the phase relationship between $e_p(n)$ and $e_c(n)$ has been changed due to the previous bit-stream packet loss. One simple solution to solve this issue is just to completely cut (remove) the pitch contribution between frames; this means the pitch gain $G_p$ 305 or 705 is set to zero in the encoder. Although this kind of solution solved the error propagation problem, it sacrifices too much the quality when there is no bit-stream packet loss or it requires much higher bit rate to achieve the same quality as the LTP is used. The invention explained in the following will provide a compromised solution.

Figure 5:
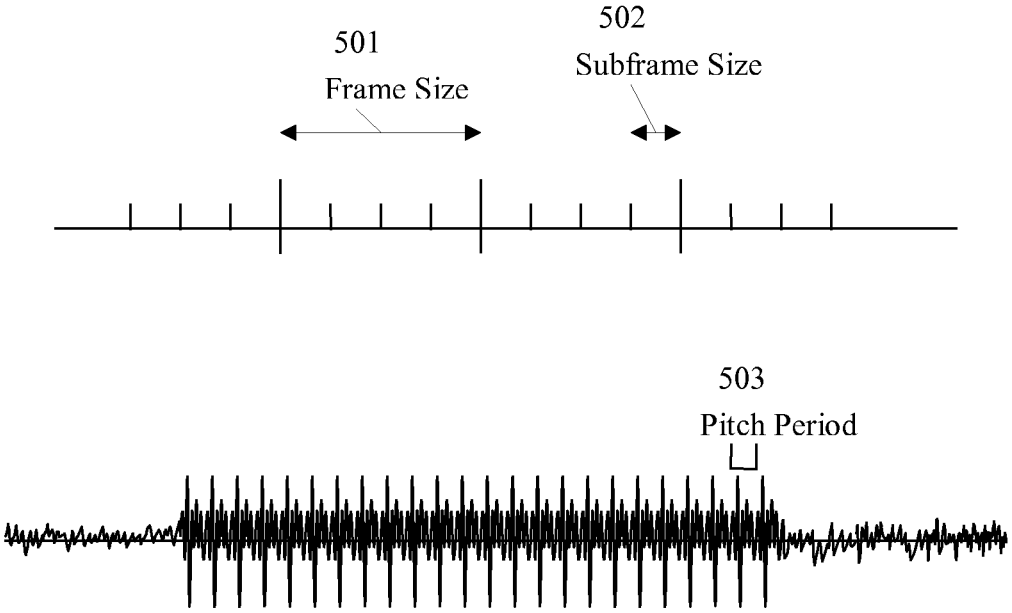
FIG. 5 shows an example that a pitch period is smaller than a subframe size.
Figure 6:
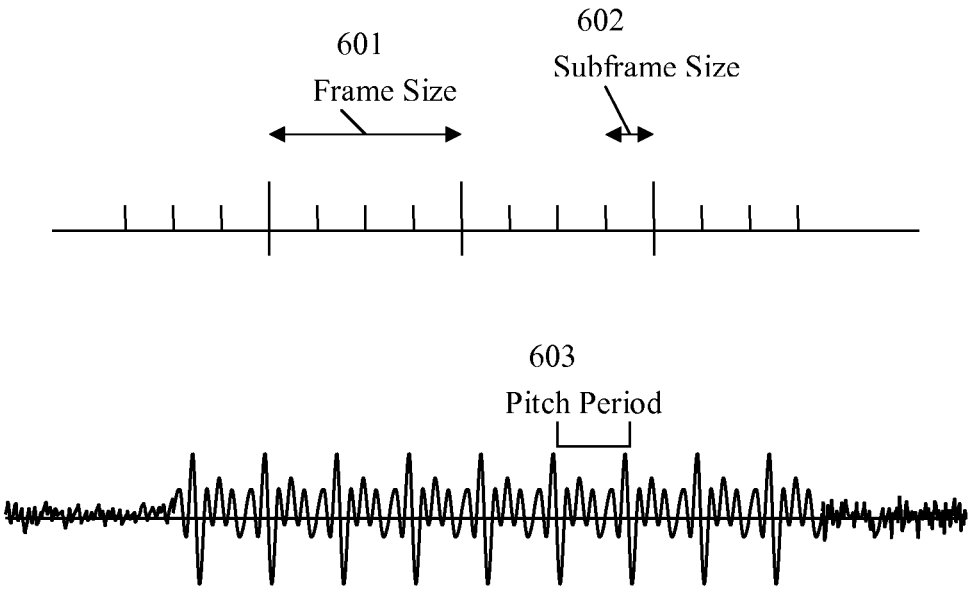
FIG. 6 shows an example with which a pitch period is larger than a subframe size and smaller than a half frame size.

For most voiced speech, one frame contains several pitch cycles. FIG. 5 shows an example that a pitch period 503 is smaller than a subframe size 502. FIG. 6 shows an example with which a pitch period 603 is larger than a subframe size 602 and smaller than a half frame size. If the speech is very voiced, a compromised solution to avoid the error propagation due to the transmission packet loss while still profiting from the significant long-term prediction gain is to limit the pitch gain maximum value for the first pitch cycle of each frame; equivalently, the energy of the LTP excitation component is reduced for the first pitch cycle of each frame or for the first subframe of each frame; when the pitch lag is much longer than the subframe size, the energy of the LTP excitation component can be reduced for the first subframe or for the first two subframes of each frame. Speech signal can be classified into different cases and treated differently. The following example assumes that a valid speech signal is classified into 4 classes:

Class 1: (strong voiced) and (pitch<=subframe size). For this frame, the pitch gain of the first subframe is reduced or limited to a value (let's say around 0.5) smaller than 1; obviously, the limitation or reduction of the pitch gain can be realized by multiplying a gain factor (which is smaller than 1) with the pitch gain or by subtracting a value from the pitch gain; equivalently, the energy of the LTP excitation component can be reduced for the first subframe by multiplying an additional gain factor which is smaller than 1. For the first subframe, the code-excitation codebook size could be larger than the other subframes within the same frame, or one more stage of excitation component is added only for the first subframe, in order to compensate for the lower pitch gain of the first subframe; in other words, the bit rate of the second excitation component for the first subframe is set to be higher than the bit rate of the second excitation component for the other subframes within the same frame. For the other subframes rather than the first subframe, a regular CELP algorithm or a regular analysis-by-synthesis algorithm is used, which minimizes a coding error or a weighted coding error in a closed loop. As this is a strong voiced frame, the pitch track is stable (the pitch lag is changed slowly or smoothly from one subframe to next subframe) and the pitch gains are high within the frame so that the pitch lags and the pitch gains can be encoded more efficiently with less number of bits, for example, coding the pitch lags and/or the pitch gains differentially from one subframe to next subframe within the same frame.

Class 2: (strong voiced) and (pitch>subframe & pitch<=half frame). For this frame, the pitch gains of the first two subframes (half frame) are reduced or limited to a value (let's say around 0.5) smaller than 1; obviously, the limitation or reduction of the pitch gains can be realized by multiplying a gain factor (which is smaller than 1) with the pitch gains or by subtracting a value from the pitch gains; equivalently, the energy of the LTP excitation component can be reduced for the first two subframes by multiplying an additional gain factor which is smaller than 1. For the first two subframes, the code-excitation codebook size could be larger than the other subframes within the same frame, or one more stage of excitation component is added only for the first half frame, in order to compensate for the lower pitch gains; in other words, the bit rate of the second excitation component for the first two subframes is set to be higher than the bit rate of the second excitation component for the other subframes within the same frame. For the other subframes rather than the first two subframes, a regular CELP algorithm or a regular analysis-by-synthesis algorithm is used, which minimizes a coding error or a weighted coding error in a closed loop. As this is a strong voiced frame, the pitch track is stable (the pitch lag is changed slowly or smoothly from one subframe to next subframe) and the pitch gains are high within the frame so that the pitch lags and the pitch gains can be encoded more efficiently with less number of bits, for example, coding the pitch lags and/or the pitch gains differentially from one subframe to next subframe within the same frame.

Class 3: (strong voiced) and (pitch>half frame). When the pitch lag is long, the error propagation effect due to the long-term prediction is less significant than the short pitch lag case. For this frame, the pitch gains of the subframes covering the first pitch cycle are reduced or limited to a value smaller than 1; the code-excitation codebook size could be larger than regular size, or one more stage of excitation component is added, in order to compensate for the lower pitch gains. Since a long pitch lag causes a less error propagation and the probability of having a long pitch lag is relatively small, just a regular CELP algorithm or a regular analysis-by-synthesis algorithm can be also used for the entire frame, which minimizes a coding error or a weighted coding error in a closed loop. As this is a strong voiced frame, the pitch track is stable and the pitch gains are high within the frame so that they can be coded more efficiently with less number of bits.

Class 4: all other cases rather than Class 1, Class 2, and Class 3. For all the other cases (exclude Class 1, Class 2, and Class 3), a regular CELP algorithm or a regular analysis-by-synthesis algorithm can be used, which minimizes a coding error or a weighted coding error in a closed loop. Of course, for some specific frames such as unvoiced speech or background noise, an open-loop approach or an open-loop/closed-loop combined approach can be used; the details will not be discussed here as this subject is already out of the scope of this application.

The class index (class number) assigned above to each defined class can be changed without changing the result. For example, the condition (strong voiced) and (pitch<=subframe size) can be defined as Class 2 rather than Class 1; the condition strop voiced) and (pitch>subframe & pitch<=half frame) can be defined as Class 3 rather than Class 2; etc.

In general, the error propagation effect due to speech packet loss is reduced by adaptively diminishing or reducing pitch correlations at the boundary of speech frames while still keeping significant contributions from the long-term pitch prediction.

In some embodiments, a method of improving packet loss concealment for speech coding while still profiting from a pitch prediction or Long-Term Prediction (LTP), the method comprising: having an LTP excitation component; having a second excitation component; determining an initial energy of the LTP excitation component for every subframe within a frame of speech signal by using a regular method of minimizing a coding error or a weighted coding error at an encoder; reducing or limiting the energy of the LTP excitation component to be smaller than the initial energy of the LTP excitation component for the first subframe within the frame; keeping the energy of the LTP excitation component to be equal to the initial energy of the LTP excitation component for any other subframe rather than the first subframe within the frame; encoding the energy of the LTP excitation component for every subframe of the frame at the encoder; and forming an excitation by including the LTP excitation component and the second excitation component.

Encoding the energy of the LTP excitation component comprises encoding a gain factor which is limited or reduced to the value for the first subframe to be smaller than 1. Coding quality loss due to the gain factor reduction is compensated by increasing coding bit rate of the second excitation component of the first subframe to be larger than coding bit rate of the second excitation component of any other subframe within the frame. Coding quality loss due to the gain factor reduction can also be compensated by adding one more stage of excitation component to the second excitation component for the first subframe rather than the other subframes within the frame. The energy limitation or reduction of the LTP excitation component for the first subframe within the frame is employed for voiced speech and not for unvoiced speech.

In other embodiments, a method of improving packet loss concealment for speech coding while still profiting from a pitch prediction or Long-Term Prediction (LTP), the method comprising: classifying a plurality of speech frames into a plurality of classes; and at least for one of the classes, the following steps are included: having an LTP excitation component; having a second excitation component; determining an initial energy of the LTP excitation component for every subframe within a frame of speech signal by using a regular method of minimizing a coding error or a weighted coding error at an encoder; comparing a pitch cycle length with a subframe size within a speech frame; reducing or limiting the energy of the LTP excitation component to be smaller than the initial energy of the LTP excitation component for the first subframe or the first two subframes within the frame, depending on the pitch cycle length compared to the subframe size; keeping the energy of the LTP excitation component to be equal to the initial energy of the LTP excitation component for any other subframe rather than the first subframe or the first two subframes within the frame; encoding the energy of the LTP excitation component for every subframe of the frame at the encoder; and forming an excitation by including the LTP excitation component and the second excitation component.

Encoding the energy of the LTP excitation component comprises encoding a gain factor which is limited or reduced to the value for the first subframe to be smaller than 1. Coding quality loss due to the gain factor reduction is compensated by increasing coding bit rate of the second excitation component of the first subframe or the first two subframes to be larger than coding bit rate of the second excitation component of any other subframe within the frame. Coding quality loss due to the gain factor reduction can also be compensated by adding one more stage of excitation component to the second excitation component for the first subframe or the first two subframes rather than the other subframes within the frame. The energy limitation or reduction of the LTP excitation component for the first subframe or the first two subframes within the frame is employed for voiced speech and not for unvoiced speech.

In other embodiments, a method of improving packet loss concealment for speech coding while still profiting from a pitch prediction or Long-Term Prediction (LTP), the method comprising: classifying a plurality of speech frames into a plurality of classes; and at least for one of the classes, the following steps are included: having an LTP excitation component; having a second excitation component; deciding a first subframe size based on a pitch cycle length within a speech frame; determining an initial energy of the LTP excitation component for every subframe within a frame of speech signal by using a regular method of minimizing a coding error or a weighted coding error at an encoder; reducing or limiting the energy of the LTP excitation component to be smaller than the initial energy of the LTP excitation component for the first subframe within the frame; keeping the energy of the LTP excitation component to be equal to the initial energy of the LTP excitation component for any other subframe rather than the first subframe within the frame; encoding the energy of the LTP excitation component for every subframe of the frame at the encoder; and forming an excitation by including the LTP excitation component and the second excitation component. Encoding the energy of the LTP excitation component comprising encoding a gain factor.

The initial energy of the LTP excitation component and the second excitation component are determined by using an analysis-by-synthesis approach. An example of the analysis-by-synthesis approach is Code-Excited Linear Prediction (CELP) methodology.

In other embodiments, a method of efficiently encoding a voiced frame, the method comprising: classifying a plurality of speech frames into a plurality of classes; and at least for one of the classes, the following steps are included: having an LTP excitation component; having a second excitation component; encoding an energy of the LTP excitation component by encoding a pitch gain; checking if a pitch track or pitch lags within the voiced frame are stable from one subframe to a next subframe; checking if the voiced frame is strongly voiced by checking if pitch gains within the voiced frame are high; encoding the pitch lags or the pitch gains efficiently by a differential coding from one subframe to a next subframe if the voiced frame is strongly voiced and the pitch lags are stable; and forming an excitation by including the LTP excitation component and the second excitation component. The energy of the LTP excitation component and the second excitation component can be determined by using an analysis-by-synthesis approach, which can be a Code-Excited Linear Prediction (CELP) methodology.

Figure 9:
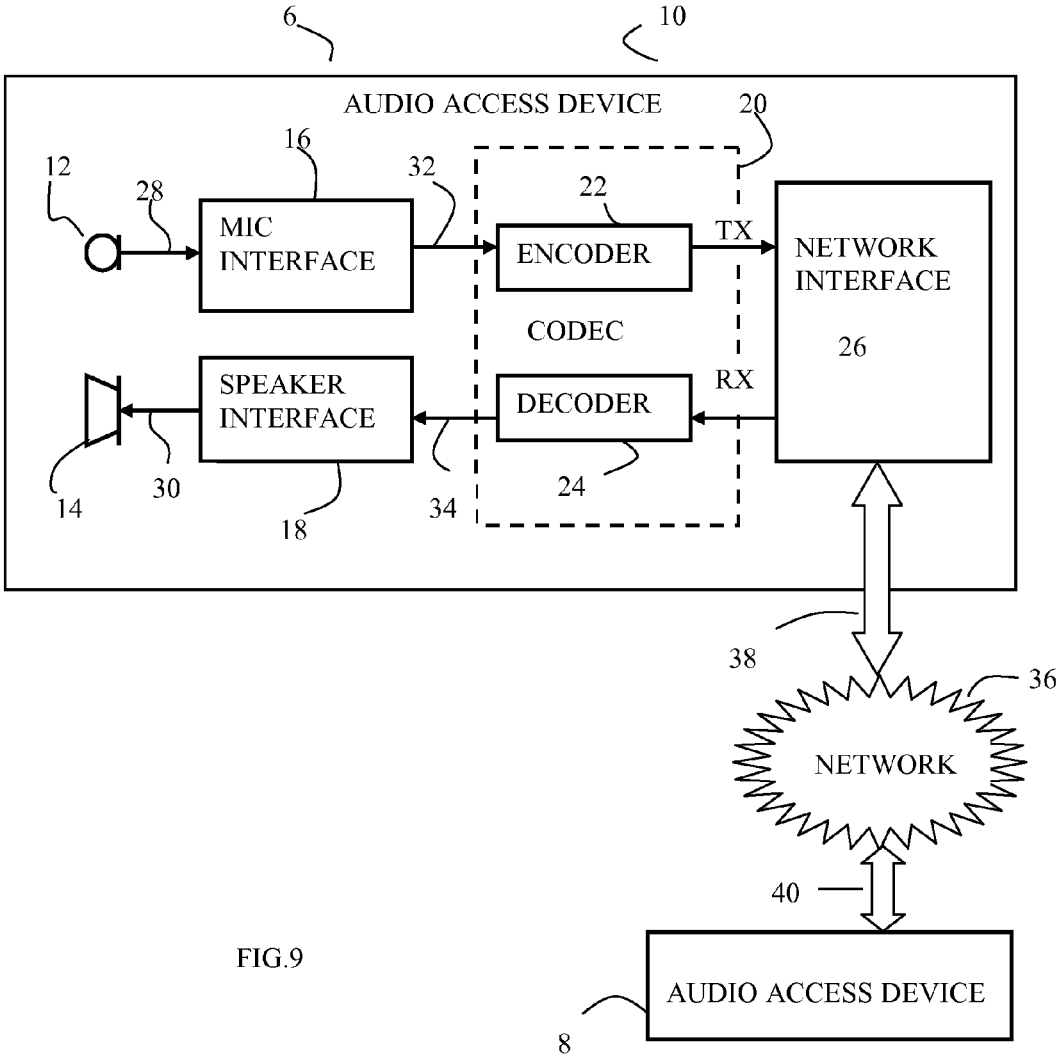
FIG. 9 illustrates a communication system according to an embodiment of the present invention.

FIG. 9 illustrates a communication system 10 according to an embodiment of the present invention. Communication system 10 has audio access devices 6 and 8 coupled to network 36 via communication links 38 and 40. In one embodiment, audio access device 6 and 8 are voice over internet protocol (VOIP) devices and network 36 is a wide area network (WAN), public switched telephone network (PSTN) and/or the internet. In another embodiment, audio access device 6 is a receiving audio device and audio access device 8 is a transmitting audio device that transmits broadcast quality, high fidelity audio data, streaming audio data, and/or audio that accompanies video programming. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network. Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In embodiments of the present invention, where audio access device 6 is a VOIP device, some or all of the components within audio access device 6 can be implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PSTN.

Although the embodiments and their advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. A method of improving packet loss concealment for speech coding within an encoder while still profiting from a pitch prediction or Long-Term Prediction (LTP), the method comprising:

having an LTP excitation component;

having a second excitation component;

determining with a processor of the encoder an initial energy of the LTP excitation component for every subframe within a frame of speech signal by using a regular method of minimizing a coding error or a weighted coding error at the encoder;

reducing or limiting the energy of the LTP excitation component to be smaller than the initial energy of the LTP excitation component for the first subframe within the frame;

keeping the energy of the LTP excitation component to be equal to the initial energy of the LTP excitation component for any other subframe rather than the first subframe within the frame;

encoding the energy of the LTP excitation component for every subframe of the frame at the encoder; and forming an excitation by including the LTP excitation component and the second excitation component.

2. The method of claim 1, wherein encoding the energy of the LTP excitation component comprises encoding a gain factor.

3. The method of claim 2, further comprising:

limiting or reducing the value of the gain factor for the first subframe to be smaller than one; and compensating for coding quality loss due to the gain factor reduction by increasing coding bit rate of the second excitation component of the first subframe to be larger than coding bit rate of the second excitation component of any other subframe within the frame.

4. The method of claim 2, further comprising:

limiting or reducing the value of the gain factor for the first subframe to be smaller than one; and compensating for coding quality loss due to the gain factor reduction by adding one more stage of excitation component to the second excitation component for the first subframe rather than the other subframes within the frame.

5. The method of claim 1, wherein the initial energy of the LTP excitation component and the second excitation component are determined by using an analysis-by-synthesis approach.

6. The method of claim 5, further comprising using a Code-Excited Linear Prediction (CELP) methodology.

7. The method of claim 1, wherein the energy limitation or reduction of the LTP excitation component for the first subframe within the frame is employed for voiced speech and is not employed for unvoiced speech.

8. An encoder for improving packet loss concealment for speech coding while still profiting from a pitch prediction or Long-Term Prediction (LTP), comprising:

a processor that implements an LTP excitation component and a second excitation component, wherein the processor is configured to:

determine an initial energy of the LTP excitation component for every subframe within a frame of speech signal by using a regular method of minimizing a coding error or a weighted coding error at the encoder;

reduce or limit the energy of the LTP excitation component to be smaller than the initial energy of the LTP excitation component for the first subframe within the frame;

keep the energy of the LTP excitation component to be equal to the initial energy of the LTP excitation component for any other subframe rather than the first subframe within the frame;

encode the energy of the LTP excitation component for every subframe of the frame at the encoder; and form an excitation by including the LTP excitation component and the second excitation component.

9. The encoder of claim 8, wherein the encoder is configured to encode the energy of the LTP excitation component using a gain factor.

10. The encoder of claim 9, wherein the encoder is further configured to:

limit or reduce the value of the gain factor for the first subframe to be smaller than one; and compensate for coding quality loss due to the gain factor reduction by increasing coding bit rate of the second excitation component of the first subframe to be larger than coding bit rate of the second excitation component of any other subframe within the frame.

11. The encoder of claim 9, wherein the encoder is further configured to:

limit or reduce the value of the gain factor for the first subframe to be smaller than one; and compensate for coding quality loss due to the gain factor reduction by adding one more stage of excitation component to the second excitation component for the first subframe rather than the other subframes within the frame.

12. The encoder of claim 8, wherein the initial energy of the LTP excitation component and the second excitation component are determined by using an analysis-by-synthesis approach.

13. The encoder of claim 12, wherein the encoder is further configured to use a Code-Excited Linear Prediction (CELP) methodology.

14. The encoder of claim 8, wherein the energy limitation or reduction of the LTP excitation component for the first subframe within the frame is employed for voiced speech and is not employed for unvoiced speech.

15. A non-transitory computer-readable medium having computer usable instructions stored thereon for execution by an encoder having a Long-Term Prediction (LTP) excitation component and a second excitation component, wherein the instructions cause the encoder to implement a method of improving packet loss concealment for speech coding within the encoder while still profiting from a pitch prediction or LTP, wherein the method comprises:

determining with a processor of the encoder an initial energy of the LTP excitation component for every subframe within a frame of speech signal by using a regular method of minimizing a coding error or a weighted coding error at the encoder;

reducing or limiting the energy of the LTP excitation component to be smaller than the initial energy of the LTP excitation component for the first subframe within the frame;

keeping the energy of the LTP excitation component to be equal to the initial energy of the LTP excitation component for any other subframe rather than the first subframe within the frame;

encoding the energy of the LTP excitation component for every subframe of the frame at the encoder; and forming an excitation by including the LTP excitation component and the second excitation component.

16. The non-transitory computer-readable medium of claim 15, wherein encoding the energy of the LTP excitation component comprises encoding a gain factor.

17. The non-transitory computer-readable medium of claim 16, wherein the method further comprises:

limiting or reducing the value of the gain factor for the first subframe to be smaller than one; and compensating for coding quality loss due to the gain factor reduction by increasing coding bit rate of the second excitation component of the first subframe to be larger than coding bit rate of the second excitation component of any other subframe within the frame.

18. The non-transitory computer-readable medium of claim 16, wherein the method further comprises:

limiting or reducing the value of the gain factor for the first subframe to be smaller than one; and compensating for coding quality loss due to the gain factor reduction by adding one more stage of excitation component to the second excitation component for the first subframe rather than the other subframes within the frame.

19. The non-transitory computer-readable medium of claim 15, wherein the initial energy of the LTP excitation component and the second excitation component are determined by using an analysis-by-synthesis approach.

20. The non-transitory computer-readable medium of claim 19, wherein the method further comprises using a Code-Excited Linear Prediction (CELP) methodology.

* * * * *